US007040459B2

(12) United States Patent
Matsuda et al.

(10) Patent No.: US 7,040,459 B2
(45) Date of Patent: May 9, 2006

(54) ELEVATOR DISPLAY SYSTEM AND METHOD

(75) Inventors: Kazuko Matsuda, Tokyo (JP); Masayuki Miyawaki, Tokyo (JP); Fuuta Yamazaki, Tokyo (JP); Kazuya Izuta, Tokyo (JP); Nobukazu Takeuchi, Toiyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 351 days.

(21) Appl. No.: 10/476,860

(22) PCT Filed: Apr. 12, 2002

(86) PCT No.: PCT/JP02/03691

§ 371 (c)(1),
(2), (4) Date: Nov. 6, 2003

(87) PCT Pub. No.: WO03/086934

PCT Pub. Date: Oct. 23, 2003

(65) Prior Publication Data

US 2004/0134718 A1 Jul. 15, 2004

(51) Int. Cl.
*B66B 3/02* (2006.01)
*B66B 1/34* (2006.01)

(52) U.S. Cl. ..... 187/399; 187/394

(58) Field of Classification Search ..... 187/391–399; 345/649, 654
See application file for complete search history.

(56) References Cited

U.S. PATENT DOCUMENTS

| | | | | |
|---|---|---|---|---|
| 4,852,696 | A * | 8/1989 | Fukuda et al. | 187/392 |
| 5,042,620 | A * | 8/1991 | Yoneda et al. | 187/382 |
| 5,886,696 | A * | 3/1999 | Kakko et al. | 715/787 |
| 6,550,587 | B1 * | 4/2003 | Yuasa et al. | 187/394 |

FOREIGN PATENT DOCUMENTS

| | | | |
|---|---|---|---|
| JP | 61-226479 | | 10/1986 |
| JP | 62-116484 | | 5/1987 |
| JP | 62-205978 | | 9/1987 |
| JP | 03046977 | A * | 2/1991 |
| JP | 6-48664 | | 2/1994 |
| JP | 06191752 | A * | 7/1994 |
| JP | 7-157218 | | 6/1995 |
| JP | 9-77399 | | 3/1997 |
| JP | 2001-310882 | | 11/2001 |
| JP | 2002-20050 | | 1/2002 |

* cited by examiner

*Primary Examiner*—Jonathan Salata
(74) *Attorney, Agent, or Firm*—Leydig, Voit & Mayer, Ltd.

(57) ABSTRACT

A display system for an elevator includes: a speed detecting device that detects speed of an elevator car; a position detecting device that detects position of the car; an operation control system that outputs speed information, stop floor information, and car position information based on a speed detection signal and a position detection signal; and a display device that displays floor names using a display control device based on the speed information, the stop floor information, and the car position information. The floor names are displayed on a display unit in a continuous manner on a circumference of a predetermined shape, so that display positions of the continuously displayed floor names are moved on the circumference of the predetermined shape in proportion to moving speed of the car.

8 Claims, 12 Drawing Sheets

FIG. 9

| POSITION Pi | DISPLAY MAGNIFICATION X(Pi) |
|---|---|
| P1 | 15% |
| P2 | 20% |
| ⋮ | |
| P7 | 70% |
| P8 | 85% |
| P9 | 100% |
| ⋮ | |
| P15 | 30% |
| P16 | 20% |

ELEVATOR DISPLAY SYSTEM AND METHOD

TECHNICAL FIELD

The present invention relates to a display system and a display method for an elevator, with which a floor name corresponding to a car position is displayed in a fun-to-view manner to thereby alleviate a confined feeling felt while in an elevator car and irritation felt while waiting for arrival of a car.

BACKGROUND ART

In a conventional display system for an elevator disclosed in Japanese Patent Laid-Open No. 07-157218 and the like, a display device is provided in an elevator car or an elevator hall to display each floor name corresponding to the current position of the elevator car on an LED dot matrix display or the like.

In another conventional display system for an elevator disclosed in Japanese Patent Laid-Open No. 61-226479, a floor name corresponding to the current position of an elevator car is scroll-displayed.

In the conventional elevator display systems described above, however, there arises a problem that displaying of the floor name is performed in a simple manner only for the purpose of informing an elevator user of the car position.

Therefore, the present invention has been made in order to solve the problem described above, and provides a display system and a display method for an elevator, with which a floor name corresponding to a car position is displayed in a fun-to-view manner to thereby alleviate a confined feeling felt while in an elevator car and irritation felt while waiting for arrival of the car.

DISCLOSURE OF THE INVENTION

A display system for an elevator according to the present invention includes: a speed detecting device that detects a speed of an elevator car and outputs a speed detection signal; a position detecting device that detects a position of the elevator car and outputs a position detection signal; and an operation control system that controls an operation of the elevator car and outputs speed information, stop floor information, and car position information based on the speed detection signal and the position detection signal.

Also, the display system includes a display device that is installed in one of the elevator car and an elevator hall, includes a display control device and a display unit, displays a plurality of floor names using the display control device based on the speed information, the stop floor information, and the car position information so that the plurality of floor names are displayed on the display unit in a continuous manner on a circumference of a predetermined shape, displays a floor name corresponding to a current position of the elevator car in a distinguishable manner from a floor name of each floor other than a current floor, and displays the plurality of continuously displayed floor names so that display positions of the plurality of continuously displayed floor names are moved on the circumference of the predetermined shape in proportion to a moving speed of the elevator car.

Further, in the display system for an elevator according to the present invention, the display device displays the floor name corresponding to the current position of the elevator car in a biggest size among the plurality of continuously displayed floor names using the display control device, and displays each floor name other than the current floor while gradually reducing a size of each floor name from the size of the floor name corresponding to the current position in accordance with an increase in distance from the current position of the elevator car.

Still further, in the display system for an elevator according to the present invention, the display device displays each stop predetermined floor in a direction in which the elevator car is traveling in a distinguishable manner from the floor name corresponding to the current position of the elevator car and each floor name other than the current floor using the display control device.

A display method for an elevator according to the present invention with which a current floor of an elevator car is indicated on a display unit provided in one of an elevator car and an elevator hall, includes: displaying, on the display unit, a loop-shaped icon array obtained by arranging a plurality of floor name icons provided for respective floors in a loop shape in the order of floor number; and rotating the loop-shaped icon array in accordance with movement of the elevator car so that a floor name icon of a current floor is arranged at a predetermined position on the display unit.

Further, in the display method for an elevator according to the present invention, the floor name icon of the current floor is displayed in a biggest size on the display unit, and other floor name icons are displayed on the display unit in sizes that are gradually reduced in accordance with an increase in distance from the floor name icon of the current floor.

Further, in the display method for an elevator according to the present invention, the floor name icon of the current floor is displayed in a specific color on the display unit, and when the current floor is changed due to travel of the elevator car, the icon displayed in the specific color is switched to a floor name icon of a new current floor.

Furthermore, in the display method for an elevator according to the present invention, a floor name icon of each stop predetermined floor is displayed in a second specific color on the display unit.

Still further, in the display method for an elevator according to the present invention, a content image corresponding to each of the stop predetermined floor is displayed beside the loop-shaped icon array on the display unit.

BRIEF DESCRIPTION OF THE DRAWINGS

FIG. 9 shows display magnifications that respectively correspond to the positions on the display unit of the elevator display system according to the second embodiment of the present invention;

BEST MODE FOR CARRYING OUT THE INVENTION

Embodiments of the present invention will now be described with reference to the accompanying drawings.

FIRST EMBODIMENT

Figure 1:
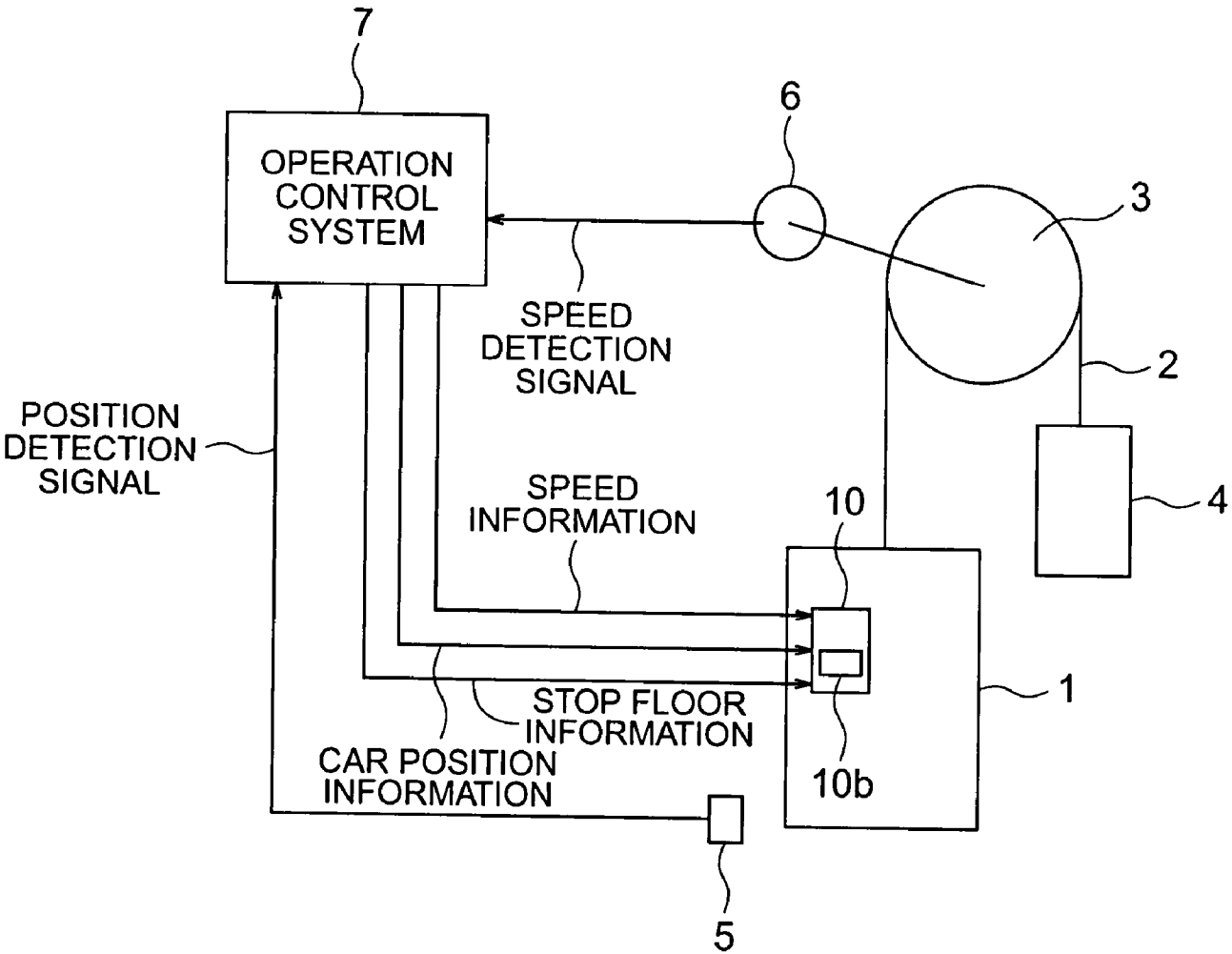
FIG. 1 shows an overall construction of a display system for an elevator according to a first embodiment of the present invention.
Figure 2:
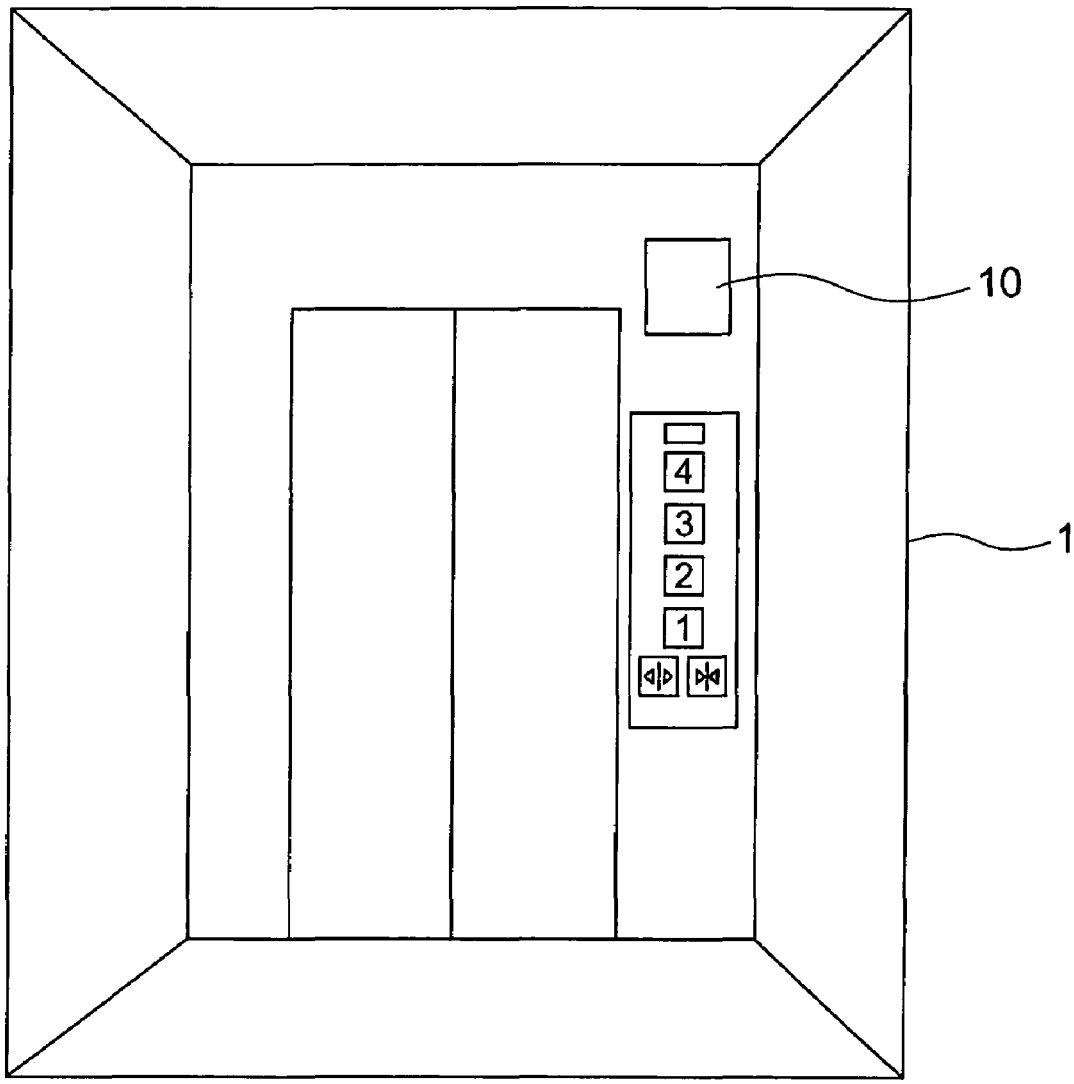
FIG. 2 shows an inside of an elevator car according to the first embodiment of the present invention.
Figure 3:
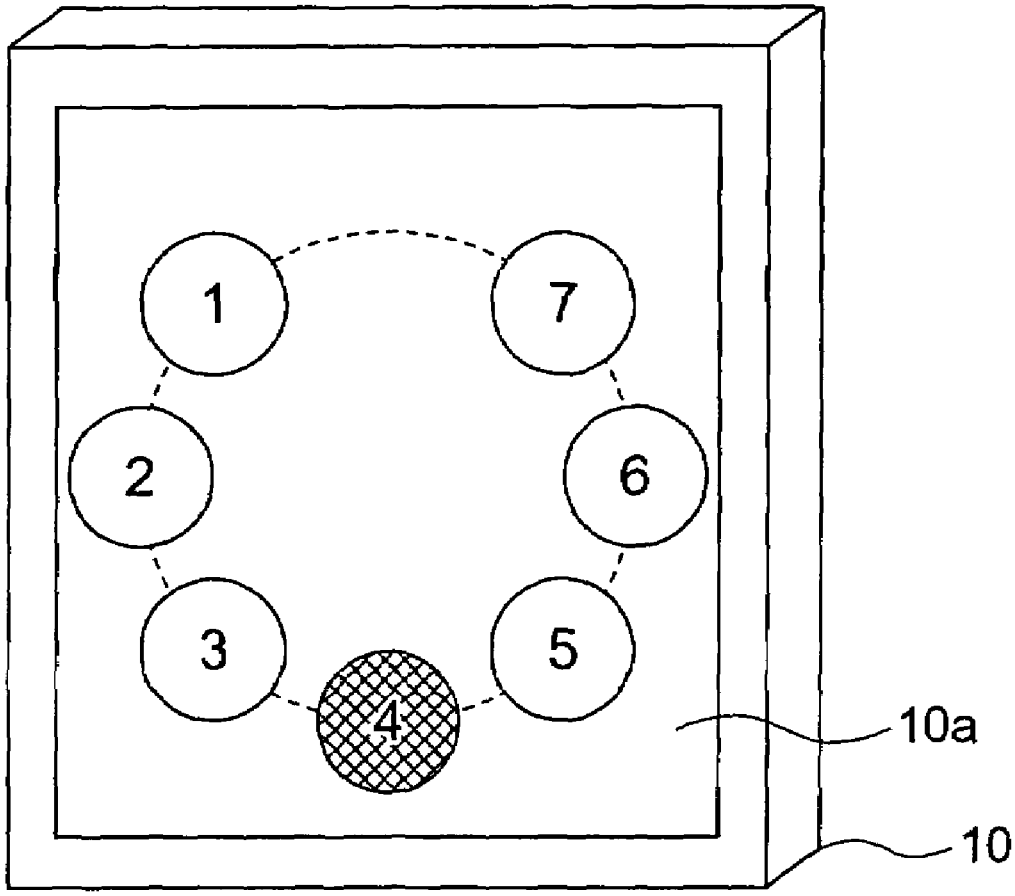
FIG. 3 shows a display device of the elevator display system according to the first embodiment of the present invention.

A display system for an elevator according to a first embodiment of the present invention will be described below with reference to the drawings. FIG. 1 shows an overall construction of an elevator display system according to the first embodiment of the present invention. Also, FIG. 2 shows an inside of an elevator car according to the first embodiment of the present invention. Further, FIG. 3 shows a display device of the elevator display system according to the first embodiment of the present invention. Note that identical symbols in the figures denote the same or the corresponding parts.

In FIG. 1, reference numeral 1 denotes an elevator car. One end of a rope 2 is connected to the elevator car 1 and the other end thereof is hung around a driving sheave 3 attached to a rotation shaft (not shown) of a hoisting machine installed in a machine room or the like to be connected to a counterweight 4.

Also, in this drawing, reference numeral 5 represents a position detecting device that detects a position of the elevator car 1, and reference numeral 6 indicates a speed detecting device (pulse encoder, for instance) that is provided to a motor driving shaft to which the driving sheave 3 is attached.

The elevator car 1 receives a driving force from the hoisting machine and travels up or down to a destination floor while striking a weight balance with the counterweight 4 through the driving sheave 3 and the rope 2.

At this time, an operation control system 7 for the elevator transmits speed information, stop floor information, and car position information to a display device 10 based on a position detection signal (floor signal indicative of the car position) from the position detecting device 5 and a speed detection signal from the speed detecting device 6.

The display device 10 is provided with an internal display control device 10*b* and displays floor names based on the speed information, the stop floor information, and the car position information described above. The display device 10 is also provided with a display unit 10*a* that is, for instance, a liquid crystal display, an EL display, or a plasma display.

As shown in FIG. 3, floor name icons indicating the current floor (fourth floor) of the car and other available floors (first to third and fifth to seventh floors) are displayed on the display unit 10*a* of the display device 10. The floor name icon of the current floor (fourth floor) is displayed in a color different from that for the other floors, or is displayed on a background whose color is different from that for the other floors, thereby making it possible for a user to distinguish the current floor from the other floors at a glance. In the first embodiment, the floor name of the current floor is displayed in "red" (specific color) and the floor names of the other available floors are displayed in "blue" (second specific color).

Figure 4:
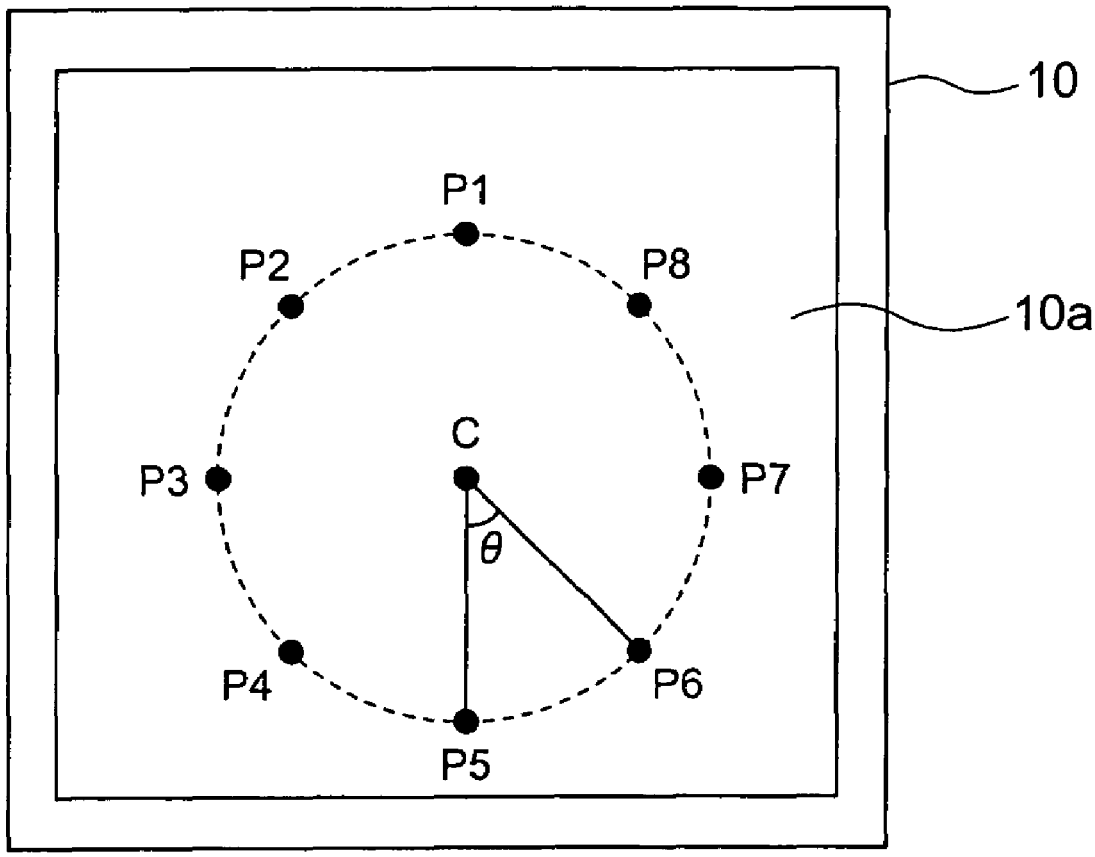
FIG. 4 shows display positions on a display unit of the elevator display system according to the first embodiment of the present invention.

FIG. 4 shows display positions on the display unit of the elevator display system according to the first embodiment of the present invention.

As shown in FIG. 4, the floor names for the elevator car 1 are arranged on a circumference of a circle (in a loop shape) as a loop-shaped icon array with a point C as the center. The positions of the floor names arranged on the circumference of the circle are determined such that points at which the floor names are to be displayed and whose number is set as "the total number of floors+1" are distributed at regular intervals. Here, the number of points is set as "the total number of floors+1" because it is desired that a space is provided between the floor name of the uppermost floor and the floor name of the lowermost floor to thereby avoid concerns about the user erroneously recognizing the floor names of the uppermost floor and the lowermost floor because these floor names are displayed adjacent to each other. The number to be added to the total number of floors in order to provide such a space may be set at any other number so long as the number to be added is greater than zero, and it is possible to appropriately adjust the display positions of the floor names by changing the number to be added in accordance with the number of floors.

Figures 5A, 5B, 5C:
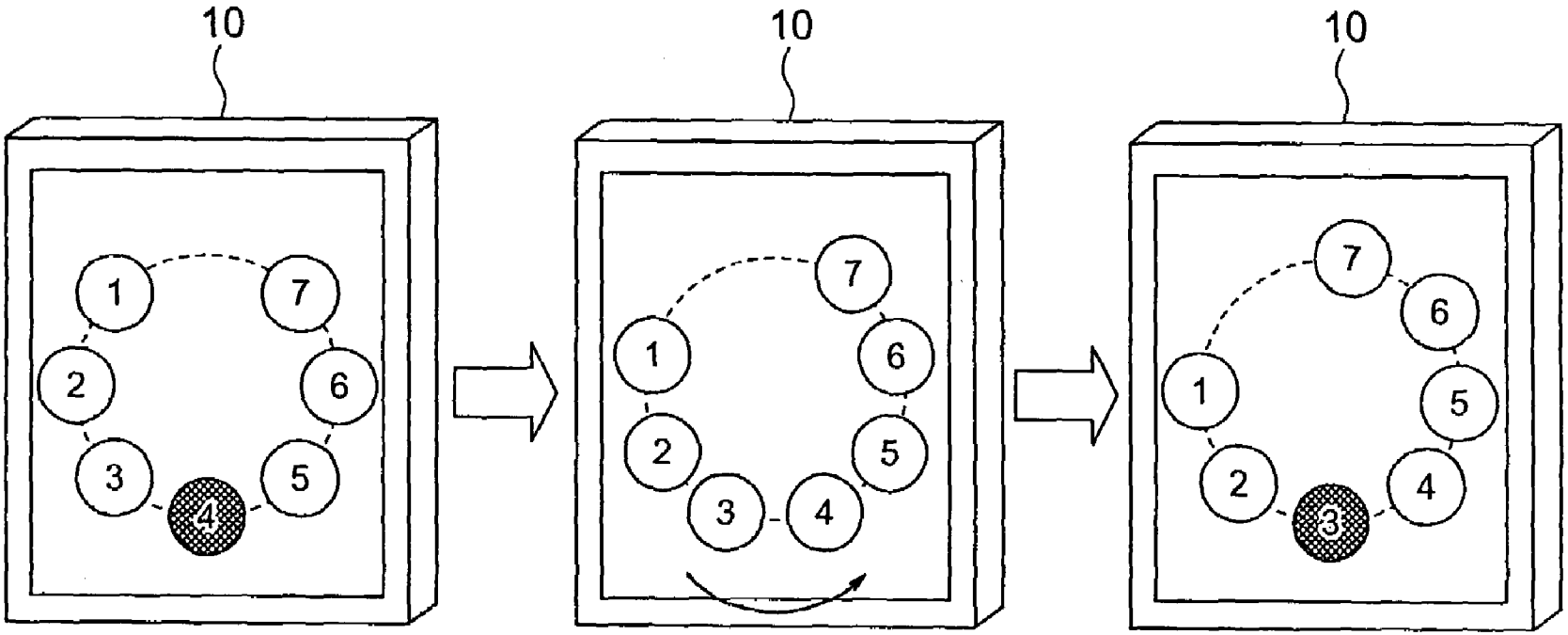
FIGS. 5(*a*), 5(*b*), and 5(*c*) show display positions of floor names moved in a counterclockwise direction on the display unit of the elevator display system according to the first embodiment of the present invention.

When the elevator car 1 travels, display positions of the floor names (that is, the loop-shaped icon array) displayed in the manner shown in FIG. 3 are rotated and moved so that the current floor is displayed on the frontward side, that is, at a position (predetermined position on the display unit) corresponding to the six o'clock position of a clock at all times. In FIGS. 5(*a*), 5(*b*), and 5(*c*), as the elevator car 1 travels down, the display positions of the floor names are moved in a counterclockwise direction. FIG. 5(*a*) shows a state where the car is positioned at the fourth floor, FIG. 5(*b*) shows a state where the car is traveling from the fourth floor to the third floor, and FIG. 5(*c*) shows a state where the car is positioned at the third floor.

Displaying of the floor names during the travel of the car is controlled by the display control device 10*b* embedded in the display device 10 based on each piece of information transmitted from the operation control system 7. At the time of low-speed travel, the display control device 10*b* divides each section (section between P5 and P6 in FIG. 4, for instance) into 20 sub-sections, for instance, and displays the floor names while moving their display positions by one sub-section every determined time period (100 ms, for instance) Also, during high-speed travel, the display control device 10*b* divides each section into five sub-sections, for instance, and displays the floor names while moving their display positions by one sub-section every determined time period.

Next, an operation of the display control device of the elevator display system according to the first embodiment will be described in detail with reference to the drawings.

Figure 6:
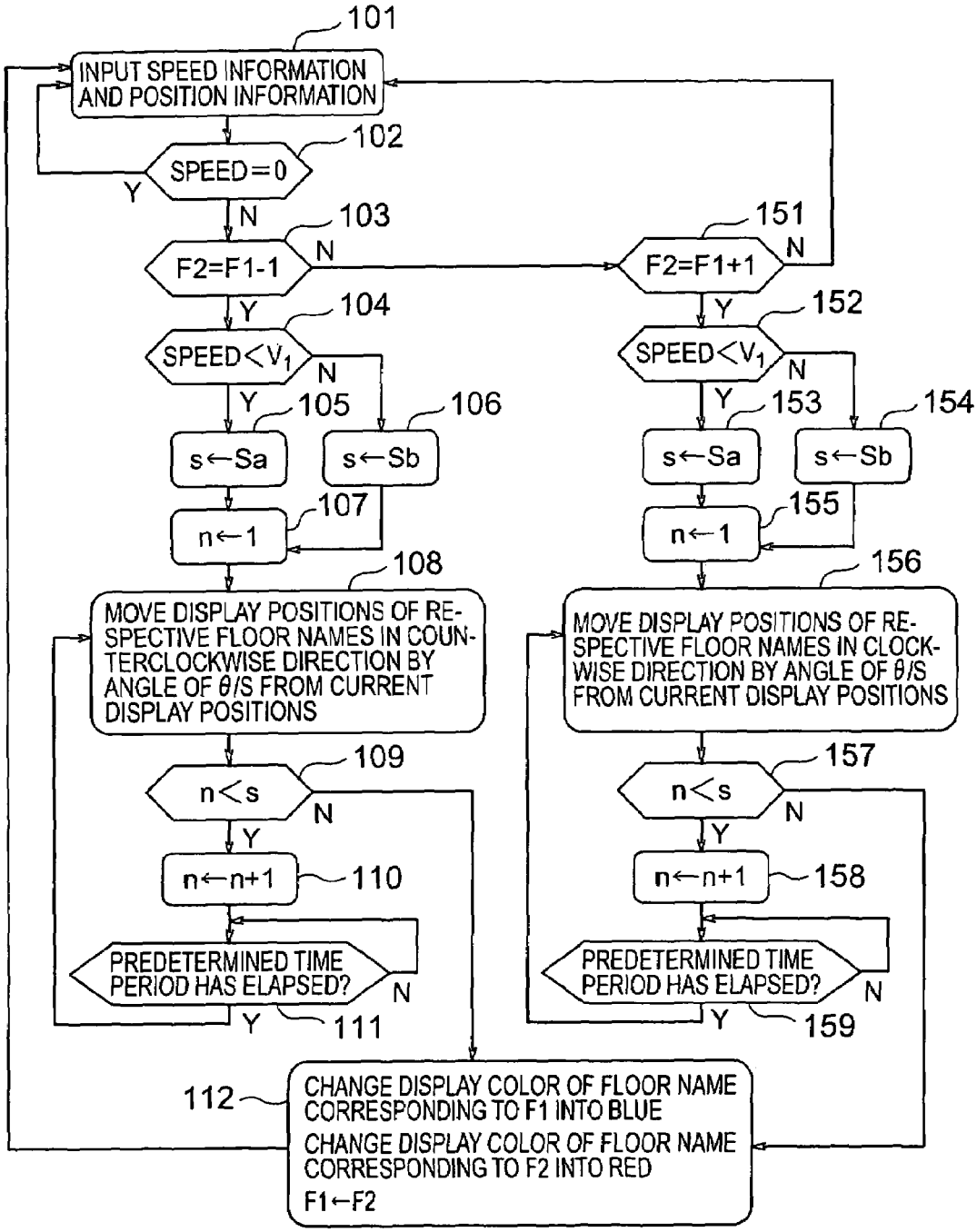
FIG. 6 is a flowchart showing an operation of a display control device of the elevator display system according to the first embodiment of the present invention.

FIG. 6 is a flowchart showing an operation of the display control device of the elevator display system according to the first embodiment.

Here, $V_1$ denotes a given reference speed for the elevator car 1, and Sa and Sb each represent the number of steps by which the floor names are moved. Here, Sa is the number of steps used when the elevator car 1 is traveling at low speed and Sb is the number of steps used when the elevator car 1 is traveling at high speed.

In this flowchart, the display positions of respective floor names are moved every fixed time period, so that Sb is set at a number that is smaller than Sa. Since a time obtained by multiplying the number of steps by the fixed time period is required to move the display positions of the floor names by a degree corresponding to one section, when the car is traveling at high speed, it is required to shorten a time required to move the display positions of the floor names by the degree corresponding to one section. As a result, Sb is set smaller than Sa.

Also, F1 indicates the floor name of the current floor of the car displayed on the display device 10 and F2 denotes the car position information transmitted from the operation control system 7. When the car is stopped, F1 and F2 becomes equal to each other.

First, in step 101, the display control device 10*b* receives the speed information, the car position information, and the stop floor information from the operation control system 7.

Next, in step 102, it is judged whether the speed is zero with reference to the speed information and, when the speed is zero (that is, the elevator car 1 is stopped), the display positions of the floor names are fixed as they are.

On the other hand, when the speed is not zero (that is, the elevator car 1 is traveling), the process proceeds to step 103 in which it is judged whether the position of the elevator car 1 is changed in the downward direction. When the car position is changed in the downward direction, the display positions of the floor names are moved in accordance with the moving speed of the car in the manner described below.

In steps 104, 105, and 107 to 111, when the car moving speed is lower than the reference speed $V_1$, it is judged that the car is traveling at low speed, so that the display positions of the respective floor names are moved by an angle of θ/Sa in the counterclockwise direction at fixed time intervals.

On the other hand, in steps 104 and 106 to 111, when the car moving speed is equal to or higher than the reference speed $V_1$, it is judged that the car is traveling at high speed, so that respective floor names are moved by an angle of θ/Sb in the counterclockwise direction at the fixed time intervals.

Next, in step 112, after the display positions of the floor names are moved by an angle of θ in the counterclockwise direction, display color of a floor name (floor name corresponding to F1) displayed hitherto in red as the current floor is changed into blue and display color of a floor name (floor name corresponding to F2) obtained as the car position information from the operation control system 7 is changed into red. Also, current floor information in the display control device 10*b* is updated (F1←F2).

The above operations (steps 101 to 112) are repeated until the car is stopped (speed becomes zero).

Also, when it is judged that the position of the car 1 is changed in the upward direction, the same operations as above (steps 101 to 103, 151 to 159, and 112) are repeated by changing the rotation direction of the display positions of the floor names into the clockwise direction.

In the first embodiment, the angle, by which the display positions of the floor names are moved, is changed in the manner described above, so that it is possible to rotate the display positions of the floor names (loop-shaped icon array) at a speed in proportion to the car speed.

In the flowchart shown in FIG. 6, the moving speed of the car is distinguished at two levels (whether the car moving speed is lower than the reference speed $V_1$ or equal to or higher than $V_1$). However, for instance, the speed judgment may be made using two steps that are the reference speed $V_1$ and another reference speed $V_2$, that is, the speed may be distinguished at three levels. By increasing the number of speed ranges and setting the number of floor name display steps with reference to the number of speed ranges, it becomes possible to obtain a rotation speed that is more suited to the actual moving speed of the car 1.

Also, in the above description, the moving angle of the display positions of the floor names is changed in accordance with the moving speed of the car. However, even if the moving angle is set constant and the time intervals for moving the display positions of the floor names are changed, the same effect is provided.

With the conventional elevator display systems, only the current floor is indicated using a seven-segment LED or the like or the current floor name among available floor names is lit up using a lamp or the like in many cases, so that the displayed contents and display operations are simple. With the elevator display system of the first embodiment, however, the current floor name and other floor names are displayed in different colors and the current floor name is displayed on the frontward side (at the six o'clock position) at all times, making it possible to perform displaying that is easy for a user to understand. Also, it is possible to change the moving speed of the display positions of the floor names in accordance with the car speed, so that it is possible to perform fun-to-view displaying that relieves boredom of an elevator user. As a result, it is conceivable that the present invention is also effective in alleviating irritation felt while waiting for arrival at a destination floor.

Also, in the above description, the floor name of the current floor is displayed in red and other available floor names are displayed in blue, although it is also possible to distinguish the current floor by displaying a circular frame or the like around each floor name and changing the color or shape of the frame or by changing the size of the floor name or the frame around the floor name.

Further, in the first embodiment, respective floor names are arranged on the circumference of a circle, although the same effect is provided even if the floor names are arranged on the circumference of an ellipse that is not a perfect circle. Further, the same effect is provided even if the floor names are arranged on the circumference of a polygon, a quadrangle, a triangle, a heart shape, a horseshoe shape, or the like. Note that the present invention is also applicable to a display device installed at an elevator hall. Also, those arrangements are each categorized as the "arrangement in a loop shape".

SECOND EMBODIMENT

Figure 7:
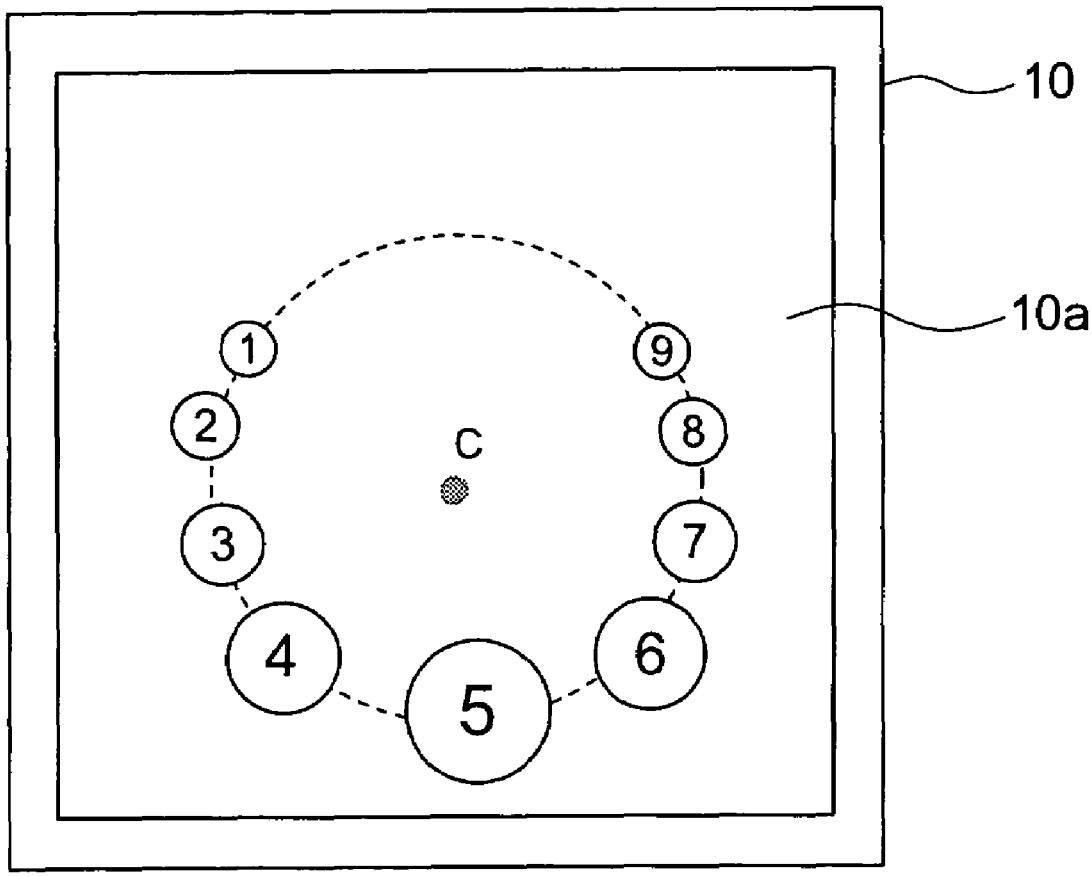
FIG. 7 shows a display device of a display system for an elevator according to a second embodiment of the present invention.

In a second embodiment, as shown in FIG. 7, the floor name of the current floor (floor name icon of the current floor) is displayed in the biggest size at the six o'clock position and other available floor names (other floor name icons) are displayed in sizes that are gradually reduced in accordance with an increase in distance from the floor name of the current floor.

Figure 8:
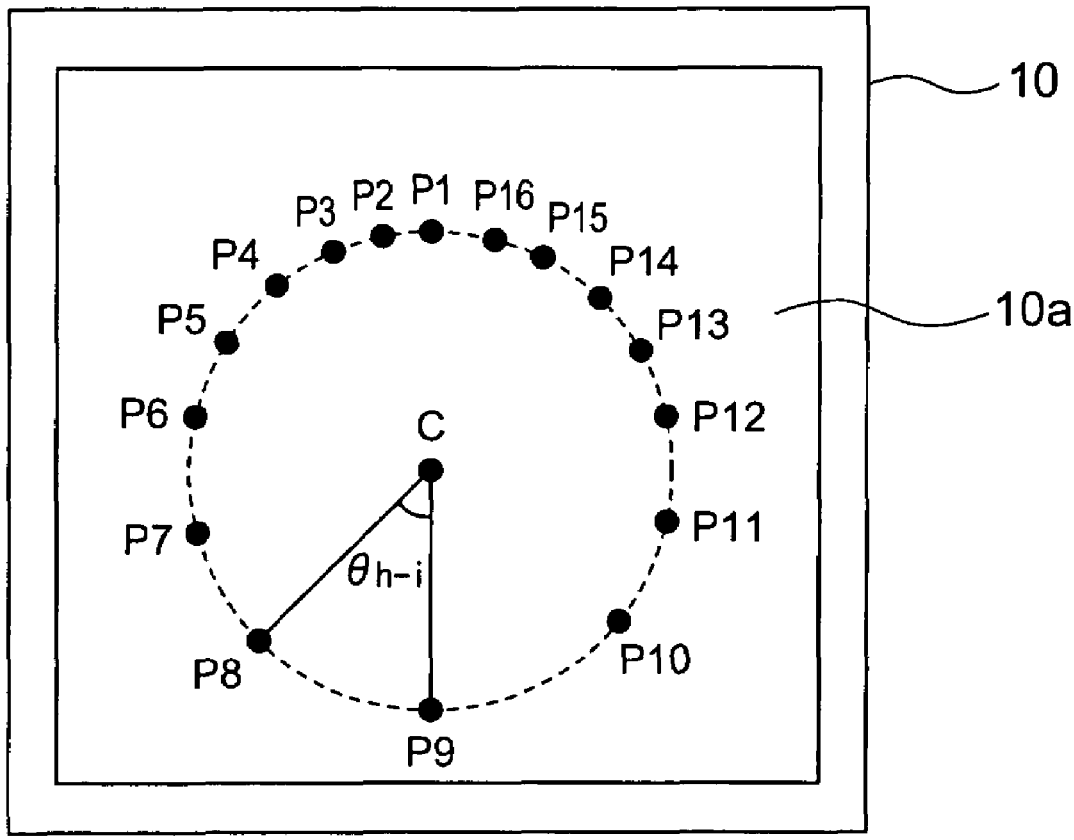
FIG. 8 shows display positions on a display unit of the elevator display system according to the second embodiment of the present invention.
Figures 10A, 10B, 10C:
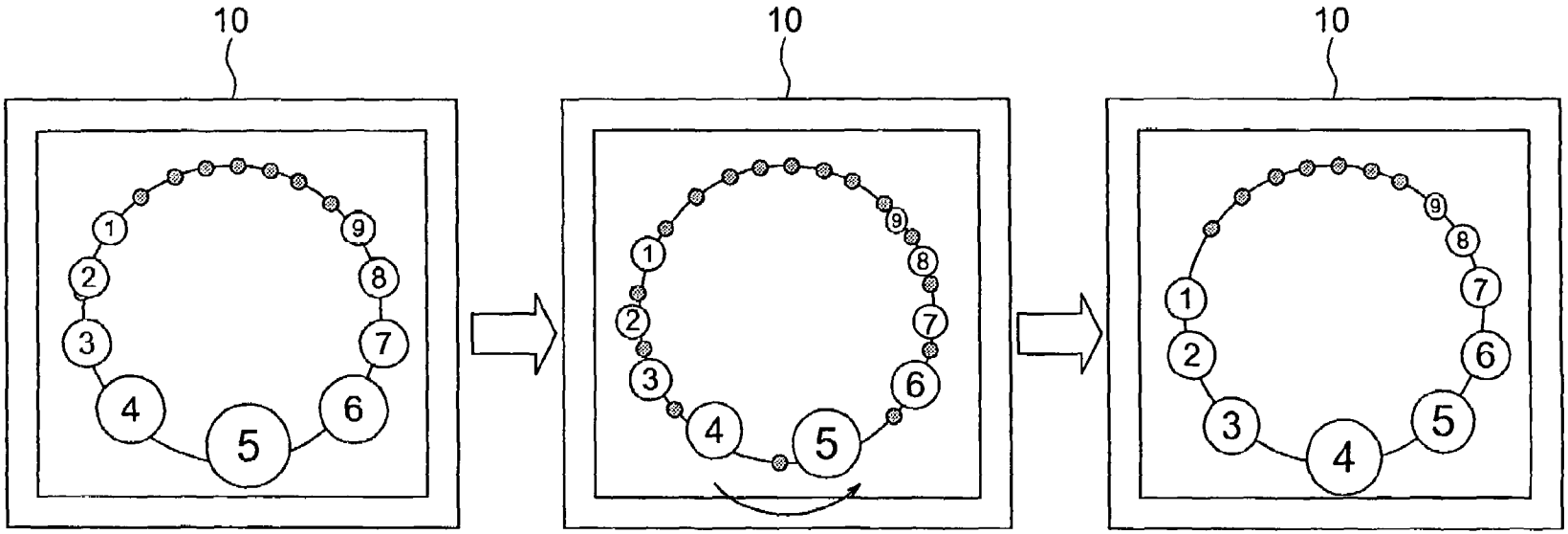
FIGS. 10(*a*), 10(*b*), and 10(*c*) show display positions of floor names moved in a counterclockwise direction on the display unit of the elevator display system according to the second embodiment of the present invention.

A display system for an elevator according to the second embodiment of the present invention will be described below with reference to the drawings. FIG. 7 shows a display unit of the elevator display system according to the second embodiment of the present invention. Also, FIG. 8 shows display positions on the display unit of the elevator display system according to the second embodiment of the present invention. Further, FIG. 9 shows display magnifications corresponding to the positions on the display unit of the elevator display system according to the second embodiment of the present invention. Also, FIG. 10 show a state where display positions of floor names on the display unit of the elevator display system according to the second embodiment of the present invention are moved in the counterclockwise direction. Note that the construction of the elevator display system according to the second embodiment is the same as that in the first embodiment described above.

As shown in FIG. 8, the display positions of respective floor names are preset at points P1 to P16 on the display unit 10*a*. In this example, the display position of the floor name of the current floor is set at the point P9 among these points.

Also, as shown in FIG. 9, the display sizes corresponding to the points P1 to P16 are set so that the display size at the display position P9, at which the floor name of the current floor is displayed, becomes 100%, the display size of the floor name at its adjacent display position P8 becomes 85%, and the display sizes are reduced in accordance with an increase in distance from the display position P9 corresponding to the floor name of the current floor. The set values of the display sizes are stored in a memory embedded in the display control device 10*b* in the display device 10.

As shown in FIG. 10, as the car 1 travels, the display positions of the respective floor names are rotated while changing the display size. The display positions of the floor names are rotated and moved so that the floor name of the current floor is displayed in the biggest size on the frontward side at all times.

In FIGS. 10(*a*), 10(*b*), and 10(*c*), as the elevator car 1 travels down, the display positions of the floor names are moved in the counterclockwise direction. FIG. 10(*a*) shows a state where the car 1 is positioned at the fifth floor, FIG. 10(*b*) shows a state where the car 1 is traveling from the fifth floor to the fourth floor, and FIG. 10(*c*) shows a state where the car 1 is positioned at the fourth floor.

Displaying of the floor name during the travel of the elevator car 1 is controlled by the display control device 10*b* embedded in the display device 10 based on each piece of information transmitted from the operation control system 7.

Next, an operation of the display control device of the elevator display system according to the second embodiment will be described in detail with reference to the drawings.

Figure 11:
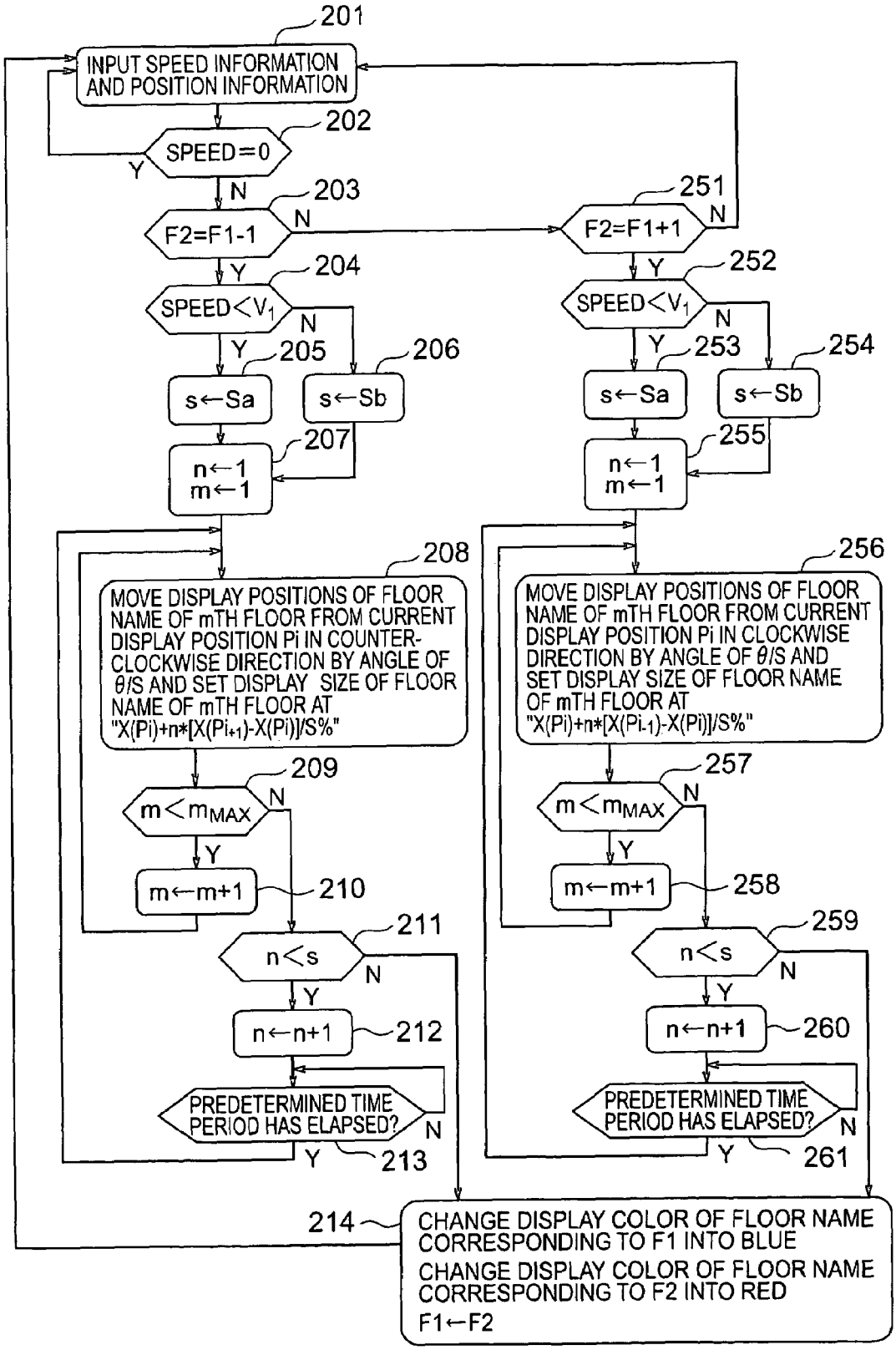
FIG. 11 is a flowchart showing an operation of a display control device of the elevator display system according to the second embodiment of the present invention.

FIG. 11 is a flowchart showing an operation of the display control device of the elevator display system according to the second embodiment.

The display control device 10*b* performs control by following the flowchart shown in FIG. 11. In the first embodiment described above, the display position each floor name is moved without changing the display size. In the second embodiment, however, the display position of each floor name is moved while changing the display size by a degree obtained by dividing a difference between the display size ($X(P_{i+1})$ or $X(P_{i-1})$ set for the floor name at the adjacent display position and the display size ($X(P_i)$) before the movement by the number of steps (Sa or Sb).

In FIGS. 7 and 8, the floor names are arranged on the circumference of a circle whose center is set at a point C, although they may be arranged on the circumference of an ellipse, as is the case of the first embodiment described above. Also, the floor name of the current floor may be distinguished from other available floor names not only by displaying the floor names in different colors but also by displaying a frame or the like around each floor name and changing the color or shape of the frame.

With the elevator display system of the second embodiment, the floor name of the current floor and other floor names are displayed while being gradually changed in size, so that it is possible to perform displaying in which there exist more motions than in the first embodiment. In the first embodiment, the floor name of the current floor and other floor names are displayed in the same display size, so that it is difficult to distinguish the current floor when there are many floors. In the second embodiment, however, each floor name other than the floor name of the current floor is displayed in a small size, so that even if there are many floors, it is possible to display the current floor in an easy-to-recognize manner. Also, the display sizes are preset in proportion to distances among the floors in a building, so that it is possible to reflect the distance from the current floor to respective floors in the display sizes. Note that the present invention is also applicable to a display device installed at an elevator hall.

THIRD EMBODIMENT

A display system for an elevator according to a third embodiment of the present invention will be described below with reference to the drawings. Also, FIGS. 12(*a*), 12(*b*), and 12(*c*) show a state where display positions of floor names are moved in a counterclockwise direction on a display system for an elevator according to the third embodiment of the present invention.

In the first and second embodiments described above, the floor name of the current floor is displayed so as to be distinguishable from other available floor names by changing its display color or the like. The third embodiment has such a feature that the floor name of the current floor, the floor name of each stop predetermined floor at which the elevator car is programmed to stop, and the floor name of each floor other than the current floor and the stop predetermined floor are displayed so as to be distinguished from one another.

Figures 12A, 12B, 12C:
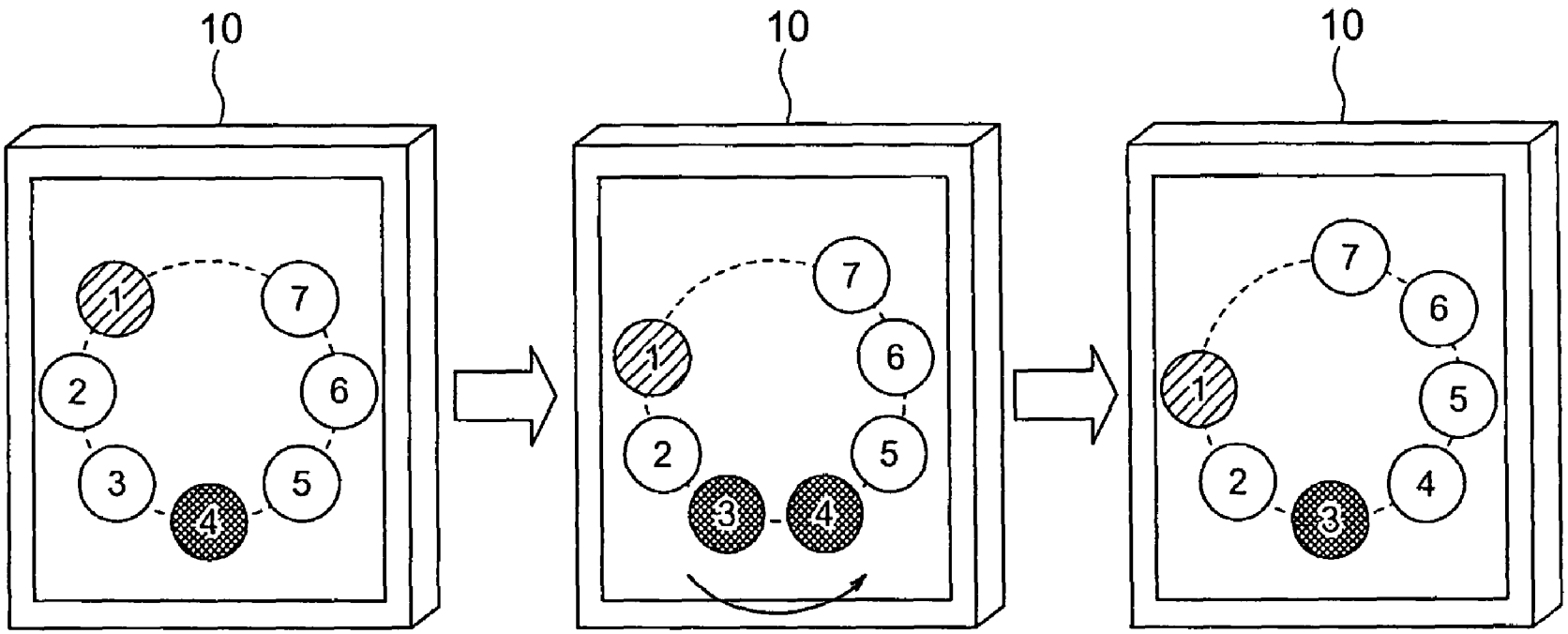
FIGS. 12(*a*), 12(*b*), and 12(*c*) show display positions of floor names moved in a counterclockwise direction on a display unit of a display system for an elevator according to a third embodiment of the present invention.

For instance, the floor name of the current floor is displayed in red, each stop predetermined floor is displayed in orange, and each floor other than the current floor and the stop predetermined floor is displayed in blue. In FIG. 12(*a*), the fourth floor is displayed in red, the first floor is displayed in orange, and other floors are displayed in blue.

A display control device 10*b* of a display device 10 controls the display colors based on the speed information, the car position information, and the stop floor information transmitted from the operation control system 7.

Displaying is performed so that each stop predetermined floor name is distinguished from the current floor and other floors. Thus, it is possible for a user in the car to know how in advance many times the elevator car 1 will stop before arriving at his/her destination floor, making it possible to prevent a situation where the user erroneously gets off the elevator car 1 at a floor that is not his/her destination floor. Also, when the display device is installed at an elevator hall, it is possible for the user to more precisely predict a time taken for the elevator car 1 to arrive at the elevator hall. As a result, it is expected that irritation felt by the user is alleviated. Note that this embodiment is also applicable to a display device installed at an elevator hall.

It should be noted here that in each embodiment described above, only the floor names of respective floors arranged in a loop shape (loop-shaped icon array) are displayed on the display unit. However, in addition to the floor names, a content image corresponding to each stop predetermined floor may be displayed on the display unit. By displaying the content image beside the floor names of respective floors (loop-shaped icon array) on the display unit, it becomes possible for the user to obtain information about each stop predetermined floor (such as event information or sale information) in advance, which improves the convenience for the user. Also, there is realized fun-to-view displaying that relieves user's boredom, so that the present invention is effective in alleviating irritation felt while waiting for arrival at a destination floor.

INDUSTRIAL APPLICABILITY

As described above, a display system for an elevator according to the present invention includes: a speed detecting device that detects a speed of an elevator car and outputs a speed detection signal; a position detecting device that detects a position of the elevator car and outputs a position detection signal; and an operation control system that controls an operation of the elevator car and outputs speed information, stop floor information, and car position information based on the speed detection signal and the position detection signal.

Also, the display system includes a display device that is installed in one of the elevator car and an elevator hall, includes a display control device and a display unit, displays a plurality of floor names using the display control device based on the speed information, the stop floor information, and the car position information so that the plurality of floor names are displayed on the display unit in a continuous manner on a circumference of a predetermined shape, displays a floor name corresponding to a current position of the elevator car in a distinguishable manner from a floor name of each floor other than a current floor, and displays the plurality of continuously displayed floor names so that display positions of the plurality of continuously displayed floor names are moved on the circumference of the predetermined shape in proportion to a moving speed of the elevator car.

As a result, a confined feeling felt while in an elevator car and irritation felt while waiting for arrival of a car are alleviated.

Further as described above, in the display system for an elevator according to the present invention, the display device displays the floor name corresponding to the current position of the elevator car in a biggest size among the plurality of continuously displayed floor names using the display control device, and displays each floor name other than the current floor while gradually reducing a size of each floor name from the size of the floor name corresponding to the current position in accordance with an increase in distance from the current position of the elevator car, whereby a confined feeling felt while in an elevator car and irritation felt while waiting for arrival of a car are alleviated.

Further as described above, in the display system for an elevator according to the present invention, the display device displays each stop predetermined floor in a direction in which the elevator car is traveling in a distinguishable manner from the floor name corresponding to the current position of the elevator car and each floor name other than the current floor using the display control device, whereby a confined feeling felt while in an elevator car and irritation felt while waiting for arrival of a car are alleviated.

Further as described above, a display method for an elevator according to the present invention with which a current floor of an elevator car is indicated on a display unit provided in one of an elevator car and an elevator hall, includes: displaying, on the display unit, a loop-shaped icon array obtained by arranging a plurality of floor name icons provided for respective floors in a loop shape in the order of floor number; and rotating the loop-shaped icon array in accordance with movement of the elevator car so that a floor name icon of a current floor is arranged at a predetermined position on the display unit. As a result, a confined feeling felt while in an elevator and irritation felt while waiting for arrival of a car are alleviated.

Further as described above, in the display method for an elevator according to the present invention, the floor name icon of the current floor is displayed in a biggest size on the display unit, and other floor name icons are displayed on the display unit in sizes that are gradually reduced in accordance with an increase in distance from the floor name icon of the current floor, whereby a confined feeling felt while in an elevator car and irritation felt while waiting for arrival of a car are alleviated.

Further as described above, in the display method for an elevator according to the present invention, the floor name icon of the current floor is displayed in a specific color on the display unit, and when the current floor is changed due to travel of the elevator car, the icon displayed in the specific color is switched to a floor name icon of a new current floor, whereby a confined feeling felt while in an elevator car and irritation felt while waiting for arrival of a car are alleviated.

Further as described above, in the display method for an elevator according to the present invention, a floor name icon of each stop predetermined floor is displayed in a second specific color on the display unit, whereby a confined feeling felt while in an elevator car and irritation felt while waiting for arrival of a car are alleviated.

Further as described above, in the display method for an elevator according to present invention, wherein a content image corresponding to each of the stop predetermined floor is displayed beside the loop-shaped icon array on the display unit, whereby alleviating a confined feeling felt while in an elevator car and irritation felt while waiting for arrival of a car.

The invention claimed is:

1. A display system for an elevator comprising:

a speed detecting device that detects speed of an elevator car and outputs a speed detection signal;

a position detecting device that detects position of the elevator car and outputs a position detection signal;

an operation control system that controls operation of the elevator car and outputs speed information, stop floor information, and car position information based on the speed detection signal and the position detection signal; and a display device installed in one of the elevator car and an elevator hall, including a display control device and a display unit that displays a plurality of floor names using the display control device based on the speed information, the stop floor information, and the car position information so that the plurality of floor names are displayed on the display unit in a continuous manner on a circumference of a predetermined shape, that displays a floor name corresponding to a current position of the elevator car distinguishably from a floor name of each floor, other than a current floor, and that displays the plurality of continuously displayed floor names so that display positions of the plurality of continuously displayed floor names are moved on the circumference of the predetermined shape in proportion to moving speed of the elevator car.

2. The display system for an elevator according to claim 1, wherein the display device displays the floor name corresponding to the current position of the elevator car in a bigger size than others of the plurality of continuously displayed floor names, using the display control device, and displays each floor name, other than the current floor, while gradually reducing size of each floor name from the size of the floor name corresponding to the current position, in accordance with an increase in distance from the current position of the elevator car.

3. The display system for an elevator according to claim 1, wherein the display device displays each stop floor in a direction in which the elevator car is traveling, distinguishably from the floor name corresponding to the current position of the elevator car, and each floor name, other than the current floor, using the display control device.

4. A display method for an elevator in which a current floor of an elevator car is indicated on a display unit provided in one of an elevator car and an elevator hall, comprising:

displaying, on the display unit, a loop-shaped icon array obtained by arranging a plurality of floor name icons provided for respective floors in a loop shape in the order of floor number; and rotating the loop-shaped icon array in accordance with movement of the elevator car so that a floor name icon of a current floor is arranged at a predetermined position on the display unit.

5. The display method for an elevator according to claim 4, wherein the floor name icon of the current floor is displayed in a bigger size on the display unit than other floor name icons, and the other floor name icons are displayed on the display unit in sizes that are gradually reduced in accordance with an increase in distance from the floor name icon of the current floor.

6. The display method for an elevator according to claim 4, wherein the floor name icon of the current floor is displayed in a specific color on the display unit, and when the current floor is changed due to travel of the elevator car, the icon displayed in the specific color is switched to a floor name icon of a new current floor.

7. The display method for an elevator according to claim 6, wherein a floor name icon of each stop floor is displayed in a second specific color on the display unit.

8. The display method for an elevator according to claim 7, wherein a content image corresponding to each of the stop floors is displayed beside the loop-shaped icon array on the display unit.

* * * * *